US011950671B2

(12) United States Patent
Samuelson

(10) Patent No.: US 11,950,671 B2
(45) **Date of Patent: *Apr. 9, 2024**

(54) LUGGAGE HANDLE

(71) Applicant: Alan Samuelson, Commerce City, CO (US)

(72) Inventor: Alan Samuelson, Commerce City, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/297,871

(22) Filed: Apr. 10, 2023

(65) Prior Publication Data

US 2023/0240418 A1 Aug. 3, 2023

Related U.S. Application Data

(63) Continuation of application No. 17/216,634, filed on Mar. 29, 2021, now Pat. No. 11,622,608.

(51) Int. Cl.
*A45C 13/26* (2006.01)

(52) U.S. Cl.
CPC ..... *A45C 13/262* (2013.01); *A45C 2013/267* (2013.01)

(58) Field of Classification Search
CPC .... A45C 5/14; A45C 2013/267; A45C 13/262
See application file for complete search history.

(56) References Cited

U.S. PATENT DOCUMENTS

| | | | | |
|---|---|---|---|---|
| 10,034,527 | B2 * | 7/2018 | Korey | A45C 13/02 |
| 2008/0217941 | A1 * | 9/2008 | Chernoff | B60N 3/023 296/1.02 |
| 2009/0064456 | A1 * | 3/2009 | Chen | A45C 13/385 16/113.1 |
| 2020/0187617 | A1 * | 6/2020 | Melkebeke | A45C 5/146 |
| 2020/0205533 | A1 * | 7/2020 | Lederer | A45C 13/262 |
| 2021/0244143 | A1 * | 8/2021 | Pang | A45C 5/03 |
| 2021/0274901 | A1 * | 9/2021 | Petrolino | A45C 13/04 |
| 2022/0218080 | A1 * | 7/2022 | Shalgi | A45C 13/26 |
| 2022/0240639 | A1 * | 8/2022 | Gooris | A45C 5/14 |

* cited by examiner

*Primary Examiner* — Christine M Mills
*Assistant Examiner* — Matthew J Sullivan
(74) *Attorney, Agent, or Firm* — Leyendecker & Lemire, LLC

(57) ABSTRACT

A luggage handle is described. Embodiments of the luggage handle can include, but are not limited to, a handle assembly and at least one case assembly. The handle assembly can be configured to move from a retracted configuration to an extended configuration. The luggage handle can typically be implemented with rolling luggage. The luggage handle can implement a ball lock mechanism that can include magnetic components.

11 Claims, 15 Drawing Sheets

LUGGAGE HANDLE

CROSS-REFERENCE TO RELATED APPLICATION

This application is a continuation of U.S. application Ser. No. 17/216,634, filed Mar. 29, 2021.

BACKGROUND

Most travelers can attest to some type of problem associated with a luggage handle of currently available luggage. For example, a loose mechanism or sticking in an extended (or retracted position) are all undesirable and have an uncanny ability to happen at an inopportune time. Further, most luggage handles currently available have noticeable play in the handle.

A luggage handle that can be durable, slack free, and smoothly operate in any orientation is needed

DETAILED DESCRIPTION

Figure 1A:
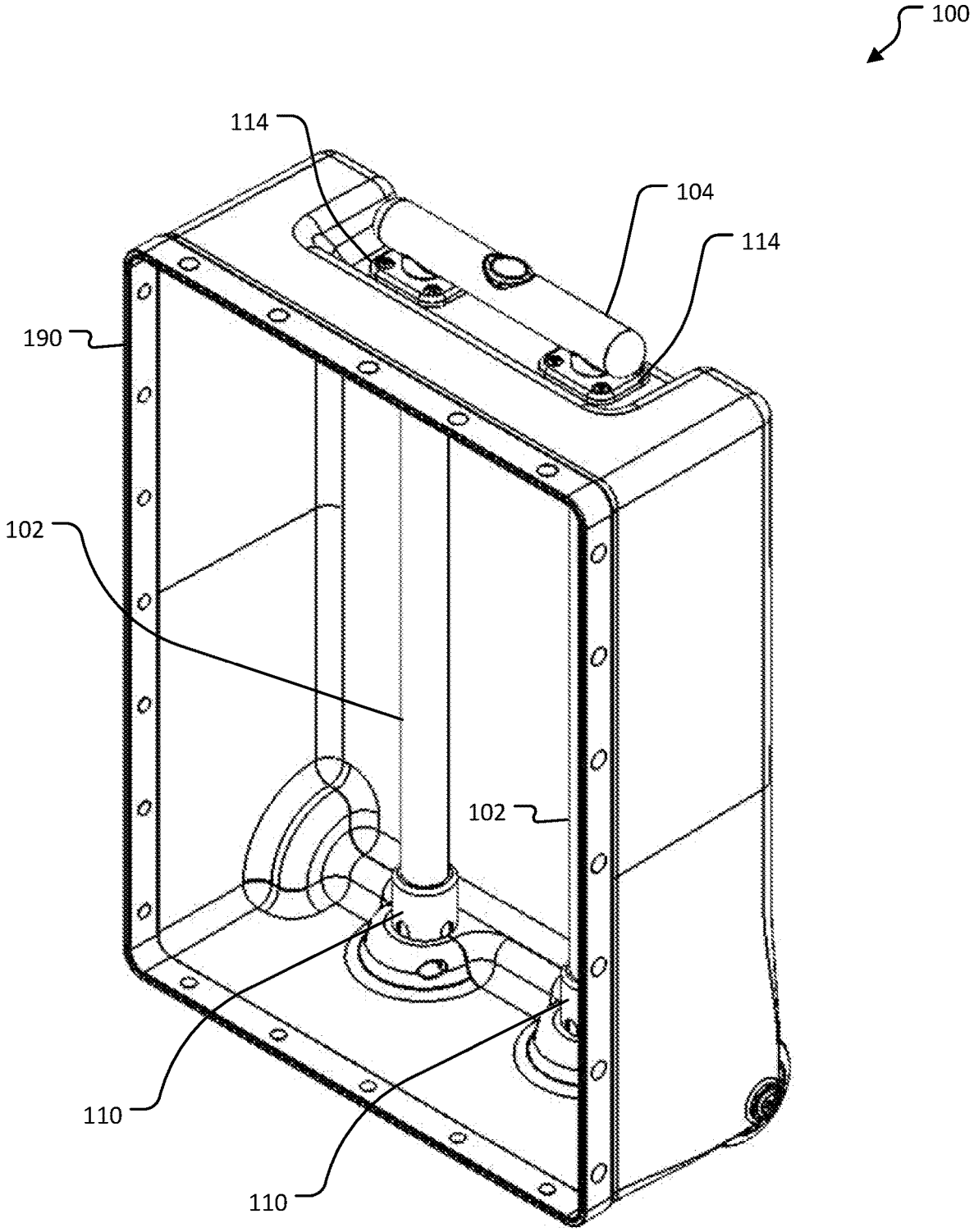
FIG. 1A is a front perspective view of a luggage handle according to one embodiment of the present invention.

Embodiments of the present invention include a luggage handle that can typically be implemented with rolling luggage. Embodiments are contemplated where the luggage handle may be implemented with other bags, containers, etc. used for transporting goods. The luggage handle can implement a ball lock style locking mechanism that can include magnetic components for locking a handle assembly in a retracted and extended configuration.

Embodiments can include a luggage handle that may incorporate several features designed to provide a robust telescoping handle while maintaining an elegant and smooth operation. The luggage handle can be integrated within a luggage shell and in some instances, can include a single telescopic assembly. The luggage handle can be made of concentric cylindrical parts and can incorporate a lock release button at a top center of the luggage handle. Of note, the concentric cylindrical parts can have varying cross-section shapes. For instance, components having spherical or square shaped cross-sections can be implemented. It is to be appreciated that the cross-sectional shape of each component can be altered without exceeding a scope of the present invention.

In one embodiment, the luggage handle can include, but is not limited to, a pair of case assemblies and a handle assembly. The case assemblies can function as containment for the handle assembly, provide structure to a luggage shell, and contain a portion of a locking mechanism for the handle assembly when either retracted or extended. The case assemblies can include, but are not limited to, a case housing, a case lower, and a case upper. The case lower and the case upper can each include one or more holes designed to allow air to flow in and out during the actuation of the handle assembly. Portions of the handle assembly can be configured to fit within the case assemblies. The case lower and the case upper can each include a groove (or race) located on an interior of the case upper and case lower that can be configured to interface with ball bearings of the handle assembly. Cross-sectional shapes of components of the case assemblies and the handle assemblies can generally be circular, however, other cross-sectional shapes can be implemented.

Of note, a typical ball lock pin mechanism functions by converting translational motion of an inner shaft into perpendicular motion of a ball bearing via a tapered plunger interfacing with the ball bearing. The ball bearing can be contained within the pin by "squishing" the housing material (pin) slightly around an edge of a hole in the pin. Pushing a spring-loaded button may release the ball bearing (assuming the pin is substantially upright) so the pin can be inserted or removed from a hole. Conversely, releasing the button forces the plunger into the ball bearing to move the ball bearing outward to provide a lock for the pin.

One undesirable aspect of the traditional ball lock pin involves the release of ball bearings back into a housing when the ball lock is oriented horizontally. Typically, once a button is pressed an upper ball bearing would fall into the housing by way of gravity but the lower ball bearing would remain in a locked position even when the plunger is not forcing the ball bearing outward. In order to remove the pin from a locking situation, a pulling force (release force) must be applied to the pin, which in turn contacts the lower ball bearing and moves it into the housing to free the pin. This problem can be increased as more ball bearings are used in this type of design. As can be appreciated, the force required to release the ball bearings adversely affected by gravity becomes greater. Another unfortunate consequence of the traditional ball lock is a potential deformation of a mating race during high loads. If a force is placed on the handle, the load would be transferred through the ball bearing to the race of the mating part. This point of contact is relatively small and with enough force, could result in material deformation where the ball bearing touches the race. Deformed material which protrudes into a telescopic bore would hinder translation of the handle in that location.

In one embodiment, the luggage handle can implement a locking mechanism similar to a ball lock pin. The locking mechanism can be used to lock the handle assembly in place via ball bearings. As can be appreciated, the luggage handle can implement a ball lock concept to lock the handle in extended and retracted positions. The locking mechanism can address the previously mentioned issues with a traditional ball lock.

The handle assembly can include, but is not limited to, a handle, a button assembly, a pair of housings, a pair of housing caps, a pair of springs, a pair of rods, a pair of ball bearing engagement members, and a plurality of ball bearings. The pair of housings can be connected to the perpendicularly oriented handle on a first end of each of the housings. In one embodiment, each of the housings can include the housing caps coupled to a second end. The housing caps can include transverse holes for containing the ball bearings that may be implemented to lock the handle assembly in place.

The pair of ball bearing engagement members, the plurality of ball bearings, and the case assemblies can be implemented as a locking mechanism. The pair of ball bearing engagement members can be implemented to interface with the plurality of ball bearings and push the ball bearings into grooves of the case assemblies, thus locking the handle assembly in place. The ball bearing engagement member can include a locking region, a transition region, and an unlocking region. The locking region can have a larger diameter than the unlocking region. Typically, the transition region can taper from the larger diameter of the locking region to the smaller diameter of the unlocking region. In some embodiments, a relationship between the ball bearing engagement member and the plurality of ball bearings can be adjusted.

In one example, four ball bearings can be implemented per case assembly. Of note, as the number of ball bearings increases, the number of ball bearings negatively affected by gravity also increases (i.e., release force increases). It is undesirable to allow multiple ball bearings in the locking mechanism to adversely affect the operation of the luggage handle. As can be appreciated, the force required to actuate the handle should remain constant throughout the entire stroke, even while releasing the handle at the locking positions.

In order to retract the ball bearings when in a locked position, the ball bearings can be moved into the housing of the handle assembly so as not to protrude beyond a diameter of the housing cap regardless of an orientation of the luggage handle or external forces. Forming the engagement member and ball bearings from magnetically attractive materials can help ensure the ball bearings stick to the engagement member in any orientation. As can be appreciated, the force required to move the handle out of a locked position can be the same as any other location within a stroke of the handle.

Typical luggage has translational slack in the handle when in a locked position. Embodiments of the engagement member can be designed to counter slack and operate smoothly during operation. The locking mechanism can be housed within the case assembly and include components from the handle assembly and case assembly. The general function of the locking mechanism can be designed to control the position of the engagement members and ultimately the ball bearings via a button in the handle assembly. Springs operatively connected to the button can apply a constant force to the rods of the handle assembly. The constant force can direct the engagement members into the ball bearings, forcing them outward, and the button toward a top center of the handle assembly. As can be appreciated, the springs can constantly act to lock the handle. Disengagement of the ball bearings can be produced by pushing the button down. When the button is pushed down, the springs can be compressed thereby moving the magnetic engagement members out of the locked position. This can allow the ball bearings to retract within the housing caps.

In some embodiments, a case upper race and a case lower race can each be manufactured with a tapered geometry. The tapered geometry can allow the ball bearings to contact a mating part outside of the case housing bore. More specially, the groove can have a diameter that is larger than an interior diameter of the case assembly. Moving the contact location outside the case assembly bore can limit a potential for material deformation and can move a location of a potential material deformation away from the bore. As can be appreciated, this can reduce potential obstructions between the handle assembly housing cap and the bore of the case assemblies.

Typically, when a handle is in an extended locked position, the handle can be prohibited from retracting by the ball bearings and prevented from further extension by the case upper and a case upper coupling member. The ball bearings engaging the case upper race and the housing cap engaging the case upper coupling member can essentially lock the housing cap from moving in either direction. While in the locked position, there may exist some slack in the handle (e.g., if one were to pull up on the handle and then push down, the handle would extend and retract by a relatively small amount). The amount of slack can vary slightly depending upon part tolerances and may serve as an annoyance to a user.

In order to remove slack from the handle assembly, the engagement member can be designed to force the ball bearings progressively outward as the engagement member moves further into the locked position. In one embodiment, the engagement member can have a uniform cylindrical geometry at both ends for locating itself within the handle assembly housing. The engagement member can include a locking region which is not uniformly cylindrical. The locking region of the engagement member can have a small taper such that as the engagement member moves in the locking direction, a diameter of the engagement member locking region can increase and force the ball bearings progressively outward. The small movement of the ball bearings further outward can be implemented to remove linear slack when the handle is in the extended locked position.

It is important to note that the locking region taper angle can be relatively small. For instance, if the taper were too steep, the handle would still lock into place, but would not support much load (i.e., pushing down on the extended locked handle with a minimal force could overpower the engagement member springs which hold the ball bearings in the locked position and thus the handle would collapse). Keeping the taper angle relatively small (just enough to take up the slack) does not reduce the ability of the lock to support loads by an appreciable amount.

Embodiments of the engagement member can include an adjustability of the engagement member location. Tolerance stacking with several assembled parts could vary the critical dimensions necessary for proper operation. The engagement member locking region identifies a "sweet spot" in which the engagement member contacts the ball bearings and functions to lock the handle in place. A locked handle assembly in which the engagement member-ball bearing contact is outside of the locking region and in the engagement member unlocking direction (while the button is not pressed), would not allow the handle to lock since the engagement member would not actively force the ball bearings outward. Conversely, if the locked assembly places the engagement member-ball bearing contact too far in the engagement member locking direction and outside of the locking region (while the button is not pressed), the button may never release the locking mechanism even when pressed all the way in. Therefore, the engagement member and rod can be assembled with threads allowing for fine adjustment of the engagement member position.

In one embodiment, the locking mechanism can be configured to provide substantially zero slack in the handle assembly. The locking mechanism can allow the engagement member to contact the ball bearings within the locking region and also allow the engagement member to locate a position of the locking mechanism while locked. The button springs can push on the button assembly and move the locking mechanism in the locking direction (forcing the button out). The button springs can continue to move the locking mechanism in the locking direction until reaching a contact feature. For instance, there may only be two contact features which could stop the movement of the handle assembly, and more specifically the locking mechanism, in the locking direction. First, the button assembly could contact the handle. Second, the locking region of the engagement member could contact the ball bearings. The locking mechanism (while locked in the extended position) should reach the engagement member-ball bearing contact point before reaching the button assembly-handle contact point. Assuring this contact limit point can provide a constant button spring force on the engagement member, and thereby removing slack, while in the locked position.

The engagement member can include a locking region, unlocking region, and transition region between the locking and unlocking regions. The transition region can lie between the unlocking region and the locking region and can include a transition radius. The transition region can have a radius larger than that of the ball bearing to facilitate a smooth return action of the button. As the button is released, the button springs force the engagement members into the ball bearings. During the locking process, the ball bearings ride along the exterior profile of the engagement members. Providing a transition region with a larger radius can assure the ball bearings continuously traverses the engagement member. In one instance, the transition region can include a curved taper from the unlocking region to the locking region. In another instance, the transition region may include a straight-line taper from the unlocking region to the locking region. In yet another instance, the transition region can include a combination of a curved taper and straight-line taper from the unlocking region to the locking region. Of note, the ball bearings can only touch the engagement member at one point of contact throughout the button stroke. Without a proper engagement member transition region, the locking system may still function but would likely lose the smooth action in button return.

In situations where excessive forces are placed on the handle, either while extended or retracted, the handle can be designed to distribute the loads such that components remain undamaged. For instance, where the interaction between the race and ball bearings provides the stroke limit, they may correspond to the weakest assumed forces. Forces exerted on the luggage handle in the extended position are commonly greater in the pulling direction rather than the pushing direction. The housing cap can contact the case upper coupling member at the extended contact limit and can prevent the handle from further extension. The race can be wide enough (e.g., in the translational direction) that the ball bearings never touch an upper side (or case upper coupling member side) of the race while applying a pulling force in operation. Therefore, pulling forces can be distributed through the housing cap to the case upper coupling member which has a greater surface contact area than if the ball bearings were preventing further extension of the handle. Thus, a greater surface contact between the housing cap and case upper coupling member can minimize the chances of material deformation to the components.

Of note, larger forces exerted on the handle in the retracted position would commonly be in a pushing direction. A large pushing force while in the retracted position can force the handle to contact the case upper coupling member before contacting another feature. Similar to the extended handle limit, the surface contact area can be much greater between the handle and case upper coupling member than the ball bearings to race contact area in the case lower. The race can be wide enough (in the translational direction) such that the ball bearings may never touch the lower portion of the case lower race during operation.

In one embodiment, a luggage handle can include, but is not limited to, a handle, a button assembly, at least one cylindrical housing, a cap member, a rod, a magnetic engagement member, and a plurality of magnetic ball bearings. The button assembly can be located substantially within the handle. The at least one cylindrical housing can have a first end coupled to the handle and can extend perpendicular to a longitudinal axis of the handle. The cap member can be coupled to a second end of the cylindrical housing and can have a plurality of apertures. The rod can have a first end operatively coupled to the button assembly and can be located within the cylindrical housing. The magnetic engagement member can be threadably coupled to a second end of the rod and can be partially located within the cylindrical housing and partially within the cap member. The plurality of magnetic ball bearings can interface directly with the magnetic engagement member and with the apertures of the cap member.

In another embodiment, a luggage handle can include, but is not limited to, a handle, a button assembly, a tubular housing, a rod, a magnetic engagement member, and a plurality of magnetic ball bearings. The button assembly can be located substantially within the handle. The tubular housing can have a first end coupled to the handle and a second end including a plurality of apertures. The tubular housing can extend perpendicular to a longitudinal axis of the handle. The rod can have a first end operatively coupled to the button assembly and a threaded second end. The rod can be located within the tubular housing. The magnetic engagement member can include a threaded bore for receiving the threaded second end of the rod. The plurality of magnetic ball bearings can interface directly with the magnetic engagement member and with the apertures of the tubular housing.

In yet another embodiment, a luggage handle can include a handle assembly and a case assembly. The handle assembly can include, but is not limited to, a handle, a button assembly, at least one cylindrical housing, a cap member, a rod, a magnetic engagement member, and a plurality of magnetic ball bearings. The button assembly can be located substantially within the handle. The at least one cylindrical housing can have a first end coupled to the handle and can extend perpendicular to a longitudinal axis of the handle. The cap member can be coupled to a second end of the cylindrical housing and can have a plurality of apertures. The rod can have a first end operatively coupled to the button assembly and can be located within the cylindrical housing. The magnetic engagement member can be threadably coupled to a second end of the rod and can be partially located within the cylindrical housing and partially within the cap member. The plurality of magnetic ball bearings can interface directly with the magnetic engagement member and with the apertures of the cap member. The case assembly can include, but is not limited to, a tubular housing, a case upper, and a case lower. The case upper can be coupled to a first end of the tubular housing and can include a groove located in an interior of the case upper. The case lower can be coupled to a second end of the tubular housing and can include a groove located in an interior of the case lower. The plurality of ball bearings can be adapted to interface with the case lower groove and the case upper groove.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "ball bearing" and "ball bearings," as used in the specification and appended claims, refers to a rigid and substantially spherical ball(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Luggage Handle

Figure 1B:
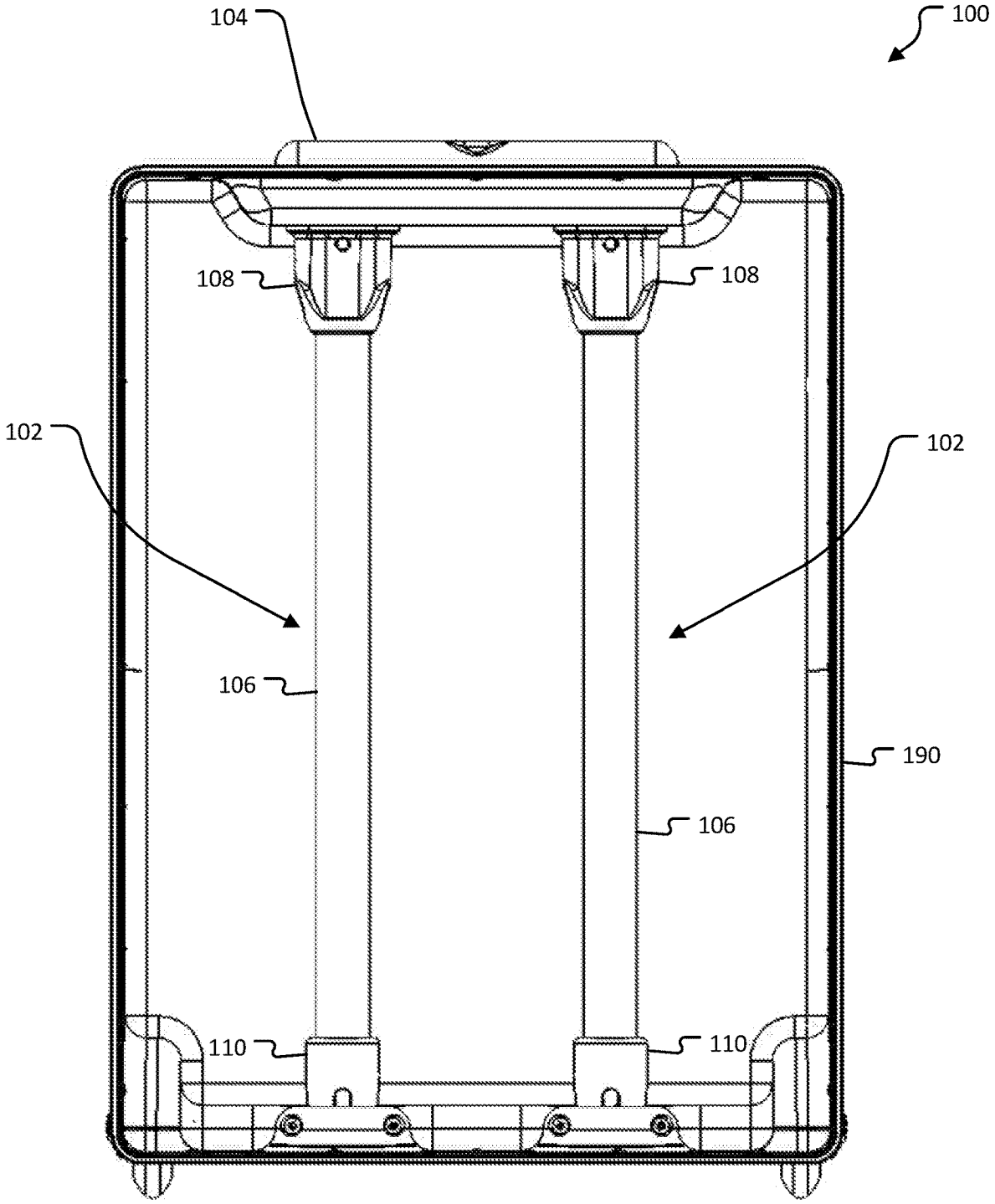
FIG. 1B is a front view of a luggage handle according to one embodiment of the present invention.
Figure 1C:
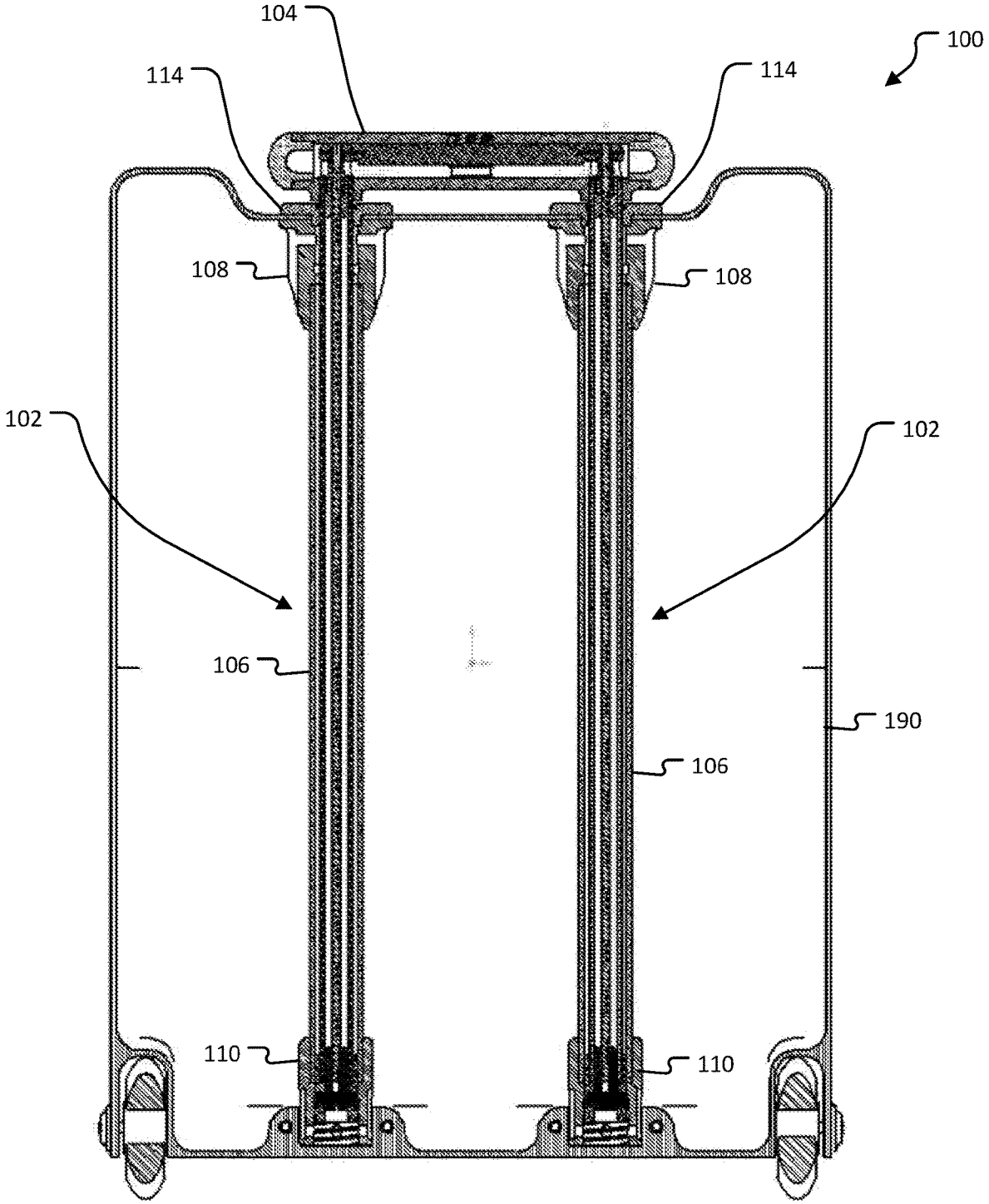
FIG. 1C is a cross-sectional view of a luggage handle according to one embodiment of the present invention.

Referring to FIGS. 1A-1C, detailed diagrams of an embodiment 100 of a luggage handle are illustrated. The luggage handle 100 can typically be implemented with a rolling container. For example, the luggage handle 100 can be implemented with a rolling suitcase 190. FIG. 1A includes a perspective view of the luggage handle 100 integrated with the rolling suitcase 190. FIG. 1B, includes a front view of the luggage handle 100 integrated with the rolling suitcase 190. FIG. 1C, includes a cross-sectional view of the luggage handle 100 integrated with the rolling suitcase 190.

As shown generally in FIGS. 1A-1C, the luggage handle 100 can include, but is not limited to, a pair of case assemblies 102 and a handle assembly 104. For illustrative purposes, the luggage handle 100 is shown integrated into a rolling suitcase 190. It is to be appreciated that the luggage handle 100 can be implemented with other containers. Further, the luggage handle 100 can be implemented with a single case assembly in lieu of two case assemblies. In such an embodiment, the components of the handle assembly 104 would be modified for a single case assembly.

Figure 2A:
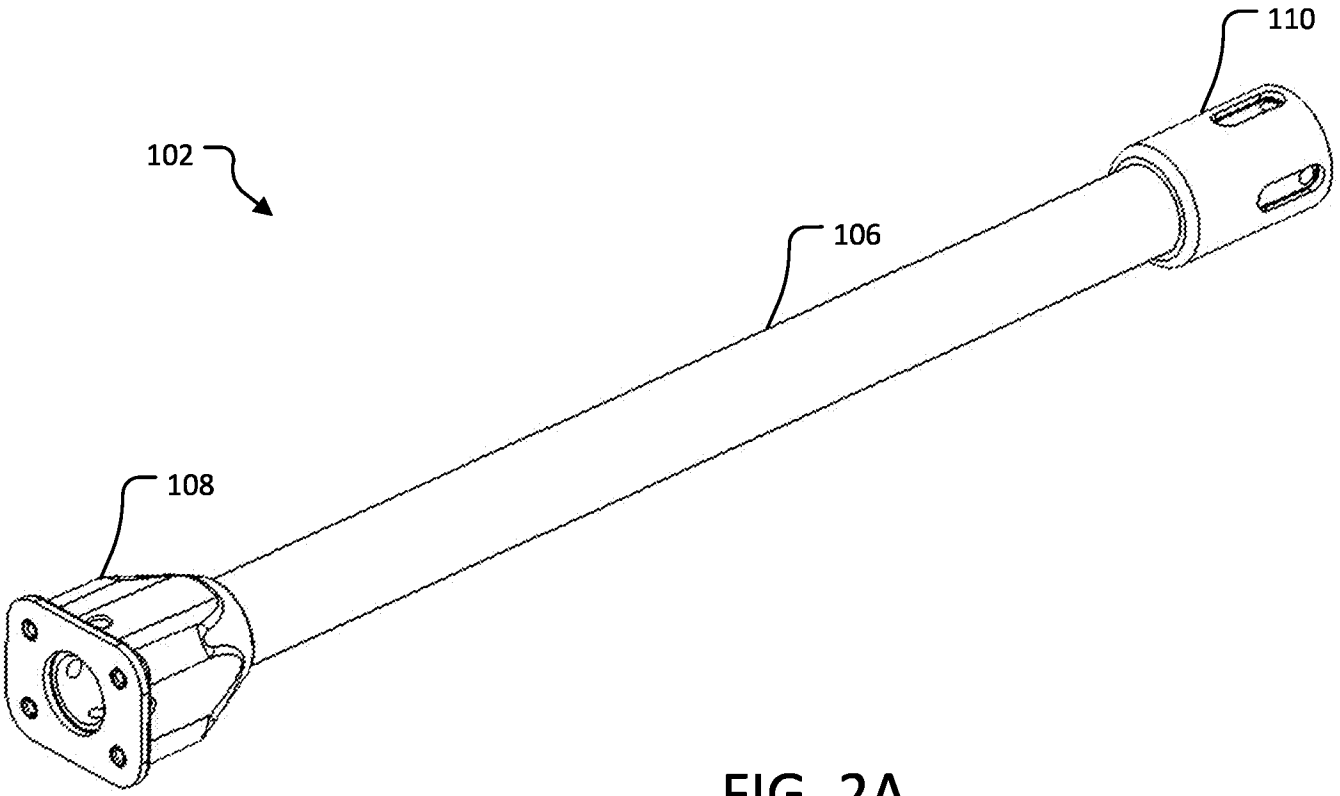
FIG. 2A is a perspective view of a case assembly according to one embodiment of the present invention.
Figure 2B:
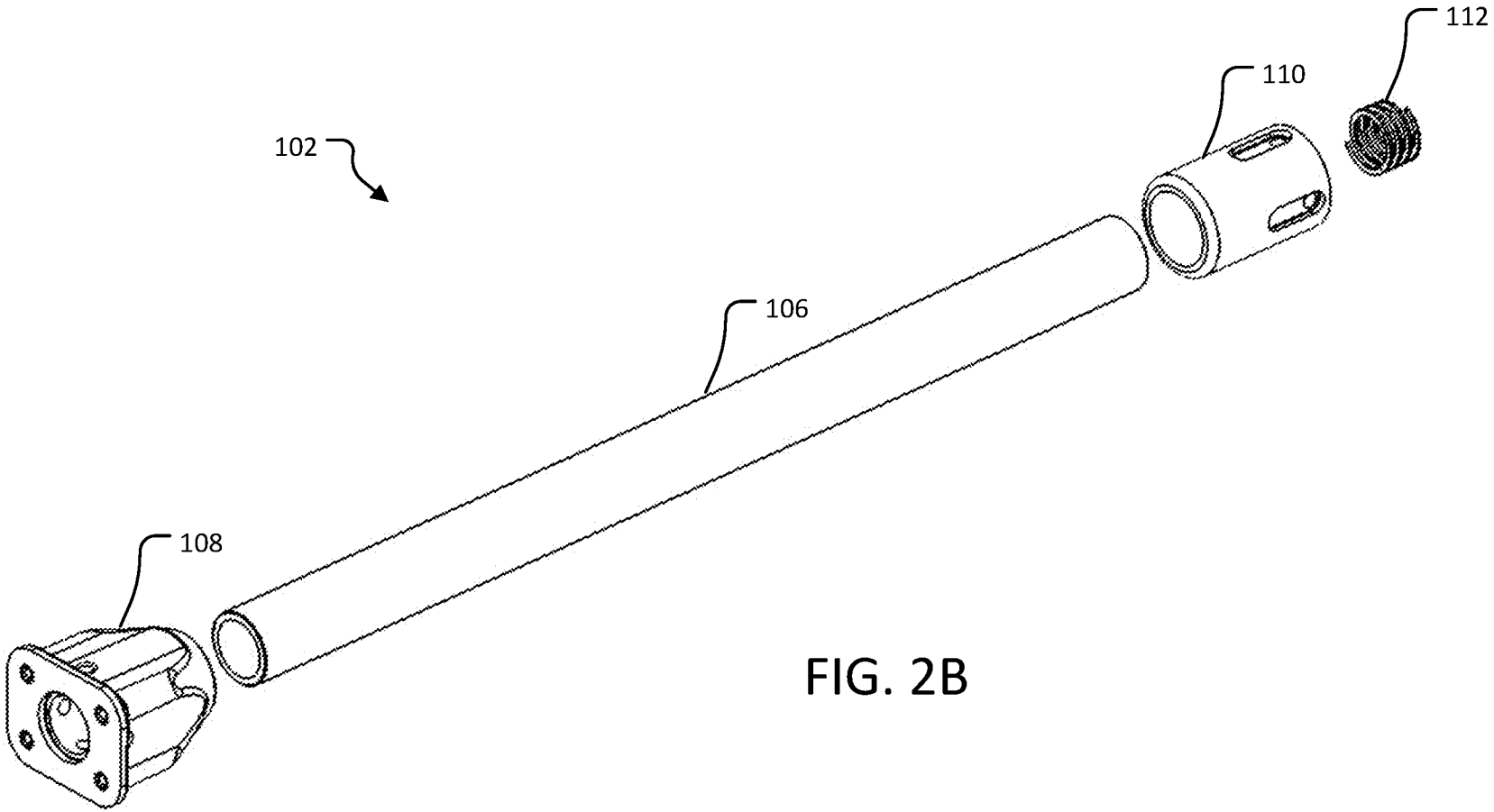
FIG. 2B is an exploded view of a case assembly according to one embodiment of the present invention.

Referring to FIGS. 2A-2B, detailed diagrams of one of the pair of case assemblies 102 are illustrated. Of note, the pair of case assemblies 102 can be substantially identical. FIG. 2A includes a perspective view of the case assembly 102. FIG. 2B includes an exploded view of the case assembly 102. As shown generally, the case assembly 102 can include, but is not limited to, a housing 106, a case upper 108, a case lower 110, and a spring 112. In some instances, the case upper 108 and the case lower 110 can be implemented to couple the case assembly 102 to a container. As shown in FIGS. 1A-1C, the case upper 108 can be coupled to and proximate a top of the suitcase 190 and the case lower 110 can be coupled to and proximate a bottom of the suitcase 190. In one embodiment, a case upper coupling member 114 (also shown in FIG. 3C) can be implemented to couple the case upper 108 to the suitcase 190. Fasteners can be implemented to sandwich a top of the suitcase 190 between the case upper coupling member 114 and the case upper 108. The case upper coupling member 114 can include a seal to help to prevent debris from entering the case assemblies 102. The case assemblies 102 can be implemented to provide structural support to the suitcase 190. Of significant note, embodiments are contemplated where features of the described case assemblies 102 can be implemented in place of the entire case assembly 102. For instance, novel features of the case assemblies 102 can be retrofitted to an existing support structure of a suitcase.

The housing 106 can typically be a rigid cylinder adapted to fit components of the handle assembly 104 therein. The case upper 108 and the case lower 110 can each include a race (or groove) configured to partially receive ball bearings therein. As will be shown later, the grooves can be located on an interior of the case upper 108 and the case lower 110. In one instance, the case upper 108 and the case lower 110 can be independent components and coupled to the case housings 106. In another instance, the case upper 108 and the case lower 110 can be manufactured as part of the case housings 106. For example, the case housings 106 can include features similar to the case upper 108 and the case lower 110 integrated into the case housings 106.

Figure 2C:
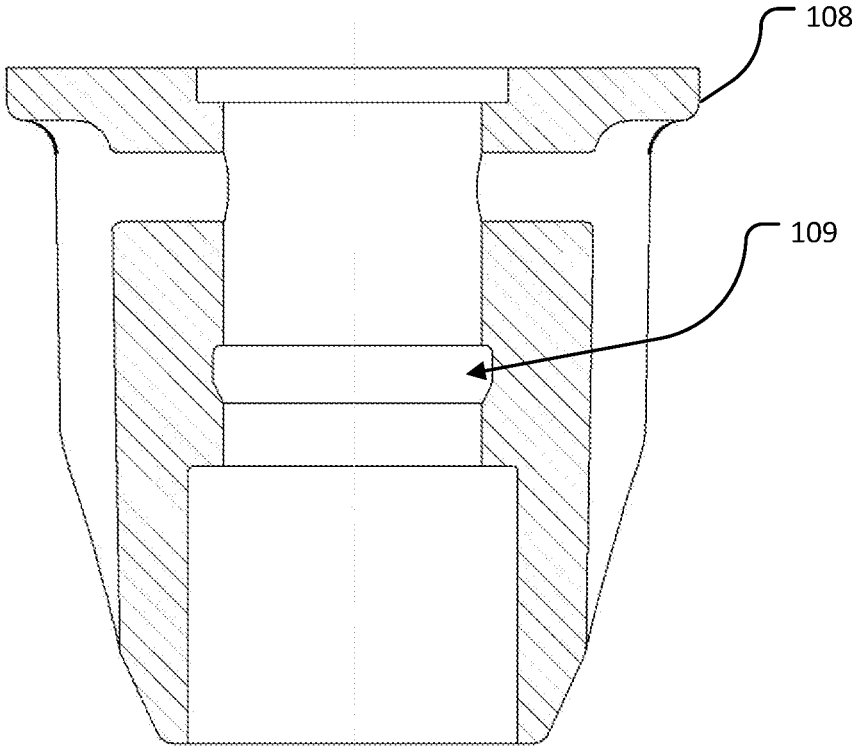
FIG. 2C is a cross-sectional view of a case upper of a case assembly according to one embodiment of the present invention.
Figure 2D:
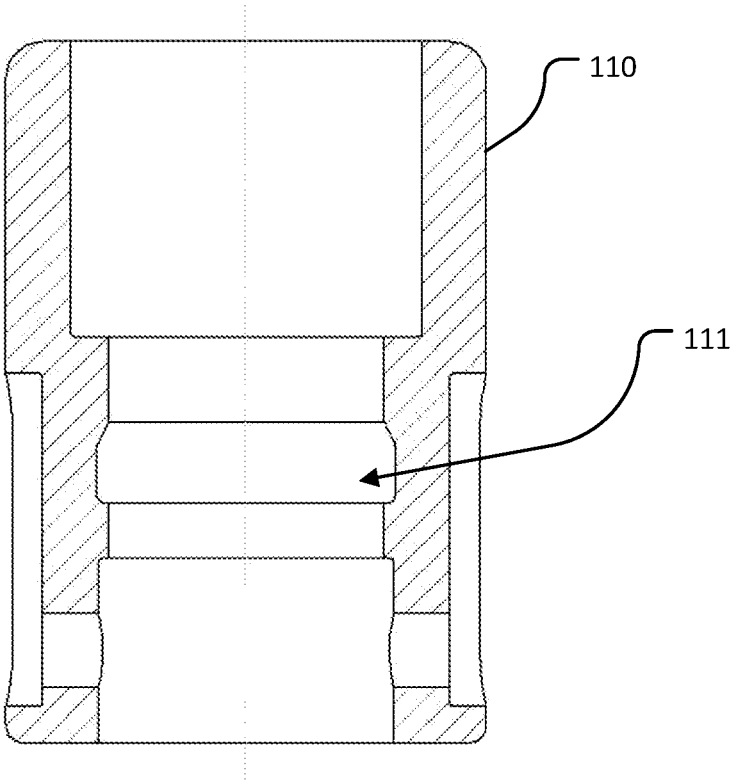
FIG. 2D is a cross-sectional view of a case lower of a case assembly according to one embodiment of the present invention.

Referring to FIGS. 2C-2D, cross-sectional views of the case upper 108 and the case lower 110 are illustrated. The case upper 108 can include a groove (or race) 109 configured to interface with ball bearings. The case lower can include a groove (or race) 111 configured to interface with ball bearings. Typically, the grooves 109, 111 can be implemented to lock the handle assembly 102 in either a retracted configuration (the case lower race 111) or in an extended configuration (the case upper race 109). The grooves 109, 111 can typically be formed outwards from a bore surface of the case upper 108 and the case lower 110. As shown, the grooves 109, 111 located in both the case upper 108 and the case lower 110 can include tapered geometry. In the case upper 108, the groove 109 can be tapered on a bottom portion of the groove 109. In the case lower 110, the groove 111 can be tapered on a top portion of the groove 111.

Figure 3A:
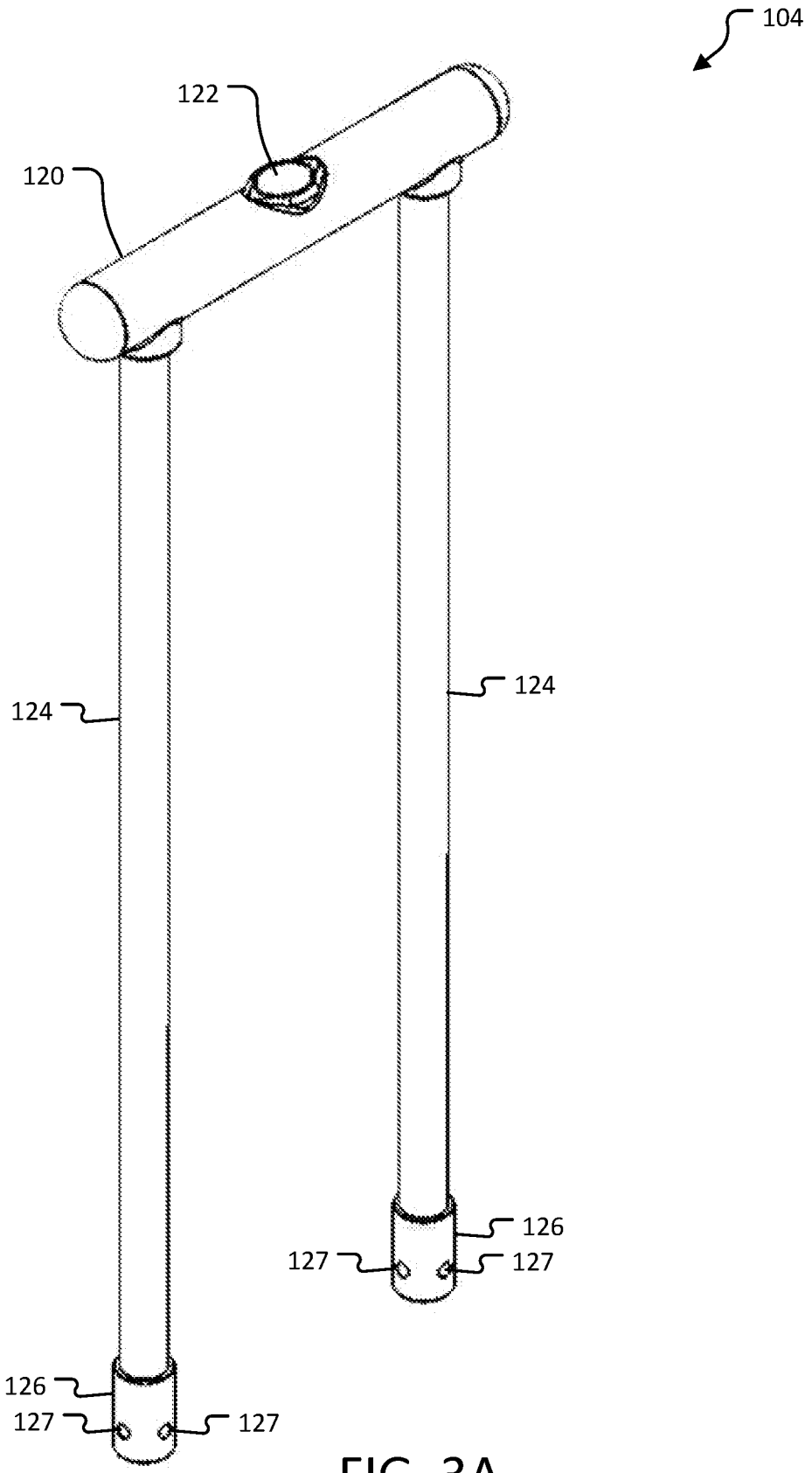
FIG. 3A is a perspective view of a handle assembly according to one embodiment of the present invention.
Figure 3B:
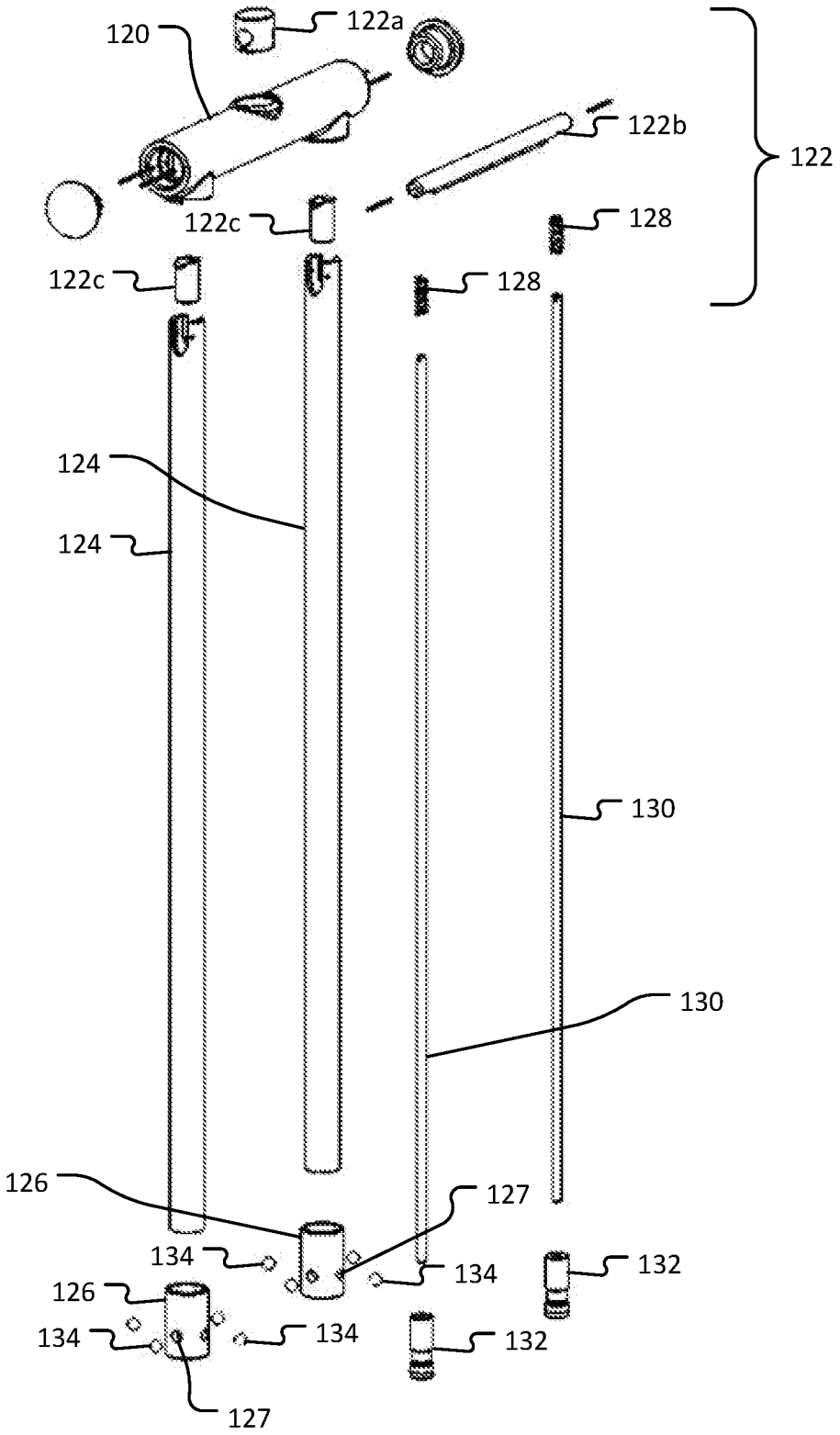
FIG. 3B is an exploded view of a handle assembly according to one embodiment of the present invention.
Figure 3C:
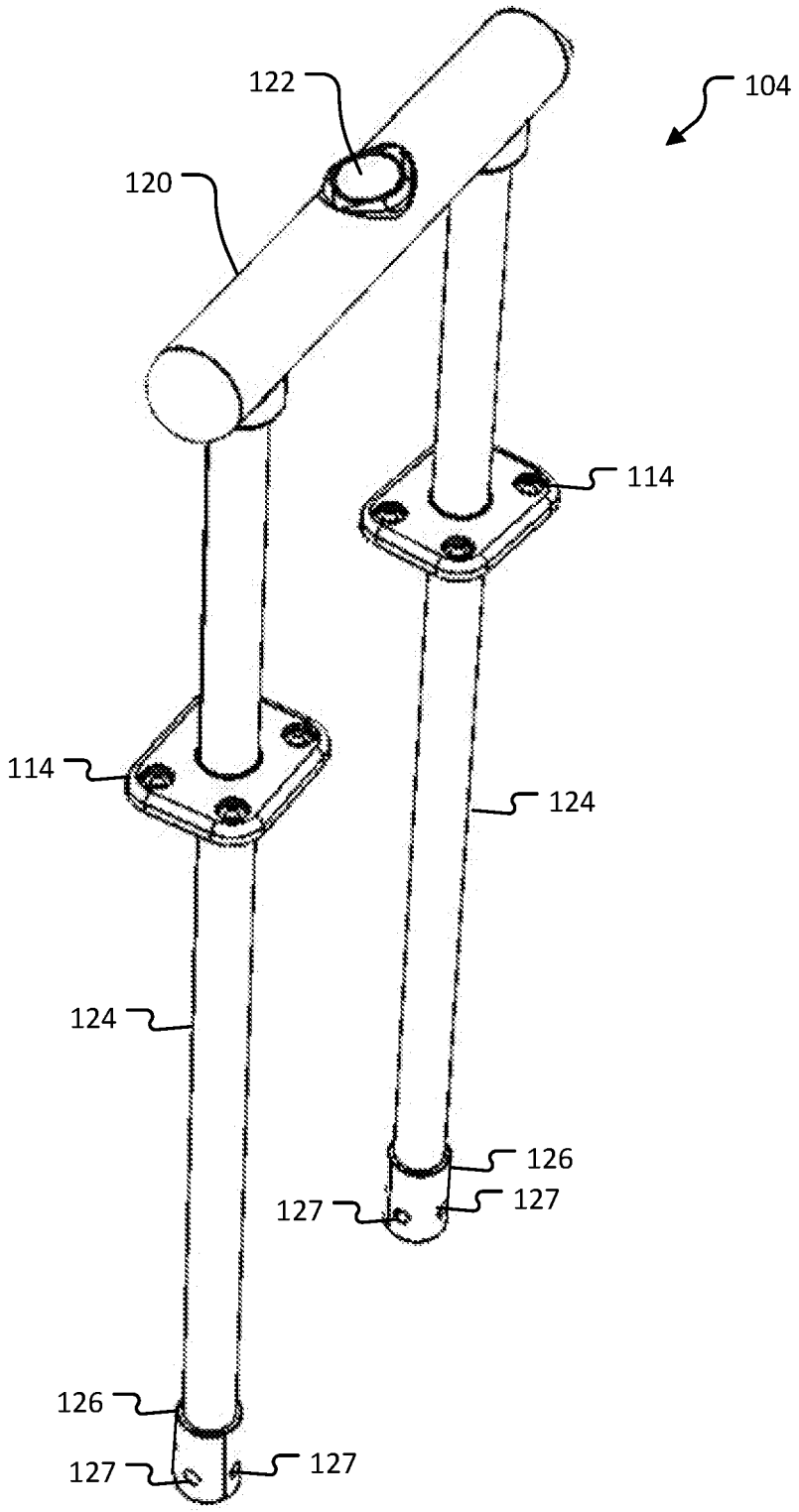
FIG. 3C is a perspective view of a handle assembly according to one embodiment of the present invention.

Referring to FIGS. 3A-3C, detailed diagrams of the handle assembly 104 are illustrated. FIG. 3A includes a perspective view of the handle assembly 104. FIG. 3B includes an exploded view of the handle assembly 104. FIG. 3C includes a perspective view of the handle assembly 104 including the case upper coupling member 114. As shown generally, the handle assembly 104 can include, but is not limited to, a handle 120, a button assembly 122, a pair of housings 124, a pair of housing caps 126, a pair of springs 128, a pair of rods 130, a pair of ball bearing engagement members 132, and a plurality of ball bearings 134. The pair of housing caps 126 can each include a plurality of apertures 127 adapted to receive a portion of the ball bearings 134 therein. In one instance, a diameter of the apertures 127 can be smaller than a diameter of the ball bearings 134 such that the ball bearings 134 will not pass entirely thru the apertures 127. In another instance, the diameter of the apertures 127 can be larger than a diameter of the ball bearings 134 such that the ball bearings 134 may pass through the apertures 127. As can be appreciated, a diameter of the apertures 127 should be large enough to allow the ball bearings 134 to move unrestricted. A magnetic coupling between the ball bearings 134 and the ball bearing engagement members 132 can help prevent the ball bearings 134 from falling out of the apertures 127. During assembly, the ball bearings 134 can be inserted into the apertures 127 which would bring the ball bearings 134 in close contact with the ball bearing engagement member 132 to allow them to magnetically couple.

Typically, a portion of the ball bearings 134 can extend past the apertures 137 to interface with the grooves 109, 111 of the case assemblies 102. As previously mentioned, embodiments are contemplated where a single case assembly can be implemented. In such an embodiment, the handle assembly can include a handle, a button assembly, a housing, a housing cap, a spring, a rod, a ball bearing engagement member, and a plurality of ball bearings.

Components of the button assembly 122 can typically be located inside the handle 120 and the handle assembly housings 124. As shown in FIG. 3B, the button assembly 122 can include, but is not limited to, a button 122*a*, a horizontal rod 122*b*, a pair of spring members 122*c*, and the pair of springs 128. In one instance, the pair of spring members 122*c* can be individually manufactured and in another instance, the pair of spring members 122*c* can be integral to the housings 124. The button assembly 122 can be operatively connected to the rods 130 to allow for a movement of the rods 130 based on the button 122*a* being depressed. For instance, the button 122*a* can be coupled to the horizontal rod 122*b* such that when the button 122*a* is pressed, the horizontal rod 122*b* can be pushed down. The pair of spring members 122*c* can be implemented to receive the springs 128 therein and provide a stop for the springs 128. The rods 124 can be sized to pass through the spring members 122*c* and the springs 128 to interface with the horizontal rod 122*b*. The pair of springs 128 can each be compressed between the horizontal rod 122*b* and the pair of spring members 122*c*. The springs 128 can provide a constant force to the horizontal rod 122*b* and the button 122*a*. To depress the button 122*a*, a user would need to compress the springs 128. Once a force is removed from the button 122*a*, the springs 128 can return the horizontal rod 122*b* and the button 122*a*. Of note, as the button 122*a* is depressed, the ball bearing engagement members 132 can be moved in a first direction. When the button 122*a* is released, the ball bearing engagement members 132 can be moved in a second direction opposite of the first direction.

In one embodiment, as shown in FIG. 3C, the case upper coupling member 114 can be part of the handle assembly 104. Typically, the case upper coupling member 114 can be slid onto the housings 124 before the housing caps 126 are secured to the housings 124. As previously mentioned, the case upper coupling member 114 can include a seal to help ensure that debris does not enter into the case assemblies 102. Of note, the handle assembly housings 124 can slide through the case upper coupling members 114. The case upper coupling members 114 can be secured in place on a suitcase by coupling to the case uppers 108.

Figure 4A:
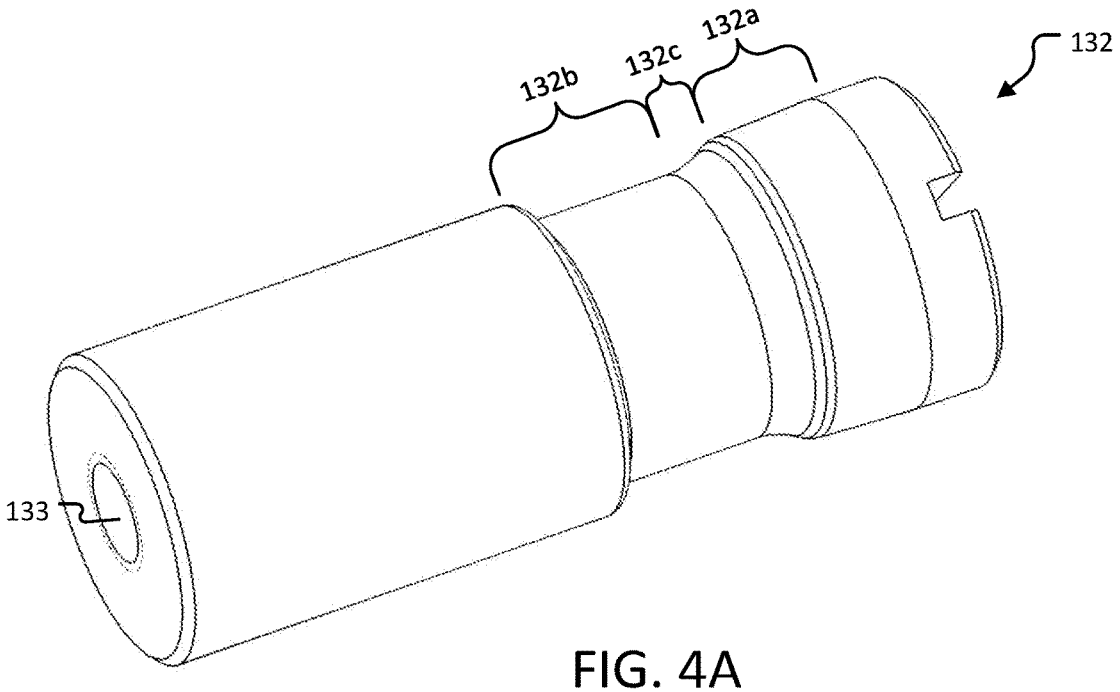
FIG. 4A is a perspective view of an engagement member according to one embodiment of the present invention.
Figure 4B:
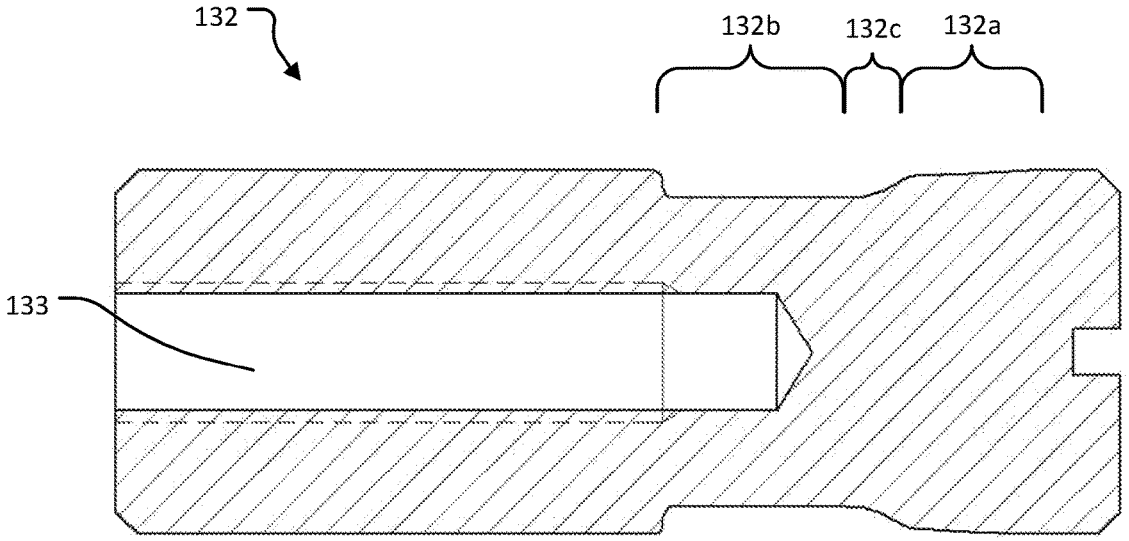
FIG. 4B is a cross-sectional view of an engagement member according to one embodiment of the present invention.

Referring to FIGS. 4A-4B, detailed diagrams of one of the ball bearing engagement members 132 are illustrated. In one embodiment, the ball bearing engagement member 132 can include a locking region 132*a*, an unlocking region 132*b*, a transition region 132*c*, and a bore 133. The transition region 132*c* can be located between the unlocking region 132*b* and the locking region 132*a* and can be defined by a transition radius. The transition region 132*c* can include a radius larger than that of the ball bearing to help facilitate a smooth return action of the button assembly 122. As the button 122*a* is released, the button springs 128 can force the ball bearing engagement members 132 into the ball bearings 134. During a locking process, the ball bearings 134 can ride along an exterior surface of the ball bearing engagement members 132. Of note, by providing a transition region with a larger radius, the ball bearings 134 may continuously traverse a surface of the ball bearing engagement member 132. Typically, the ball bearings 134 may only interface with the ball bearing engagement member 132 at one point of contact throughout a stroke of the button assembly 122. Without a proper engagement member transition region, the locking system may still function but would likely lose the smooth action in button return. In one instance, the bore 133 can be threaded.

The ball bearing engagement member 132 can be configured to remove slack from the handle assembly 104. For instance, the ball bearing engagement member 132 can be designed to force the ball bearings 134 progressively outward as the ball bearing engagement member 132 moves further into the locked position. In one embodiment, the ball bearing engagement member 132 can have a uniform cylindrical geometry at both ends for locating itself within the housing 124. The ball bearing engagement member 132 can include the locking region 132*a* which may not be uniformly cylindrical. In one instance, the locking region 132*a* of the ball bearing engagement member 132 can have a small taper such that as the ball bearing engagement member 132 moves in the locking direction, a diameter of the locking region 132*a* can increase and force the ball bearings 134 progressively outward. Of note, a small movement of the ball bearings 134 further outward can remove linear slack when the handle 120 is in the extended configuration.

Typically, the taper angle in the locking region 132*a* can be relatively small. Of note, if the taper angle were too steep, the handle 120 may still lock into place, but the handle assembly 104 would not support much load (e.g., pushing down on the extended locked handle with a minimal force could overpower the ball bearing engagement member 132 springs which hold the ball bearings in the locked position and thus the handle would collapse). As can be appreciated, by keeping the taper angle relatively small (e.g., just enough to take up the slack), this does not reduce the ability of the lock to support loads by an appreciable amount. Embodiments are contemplated where the locking region 132*a* does not include a taper.

Figure 5A:
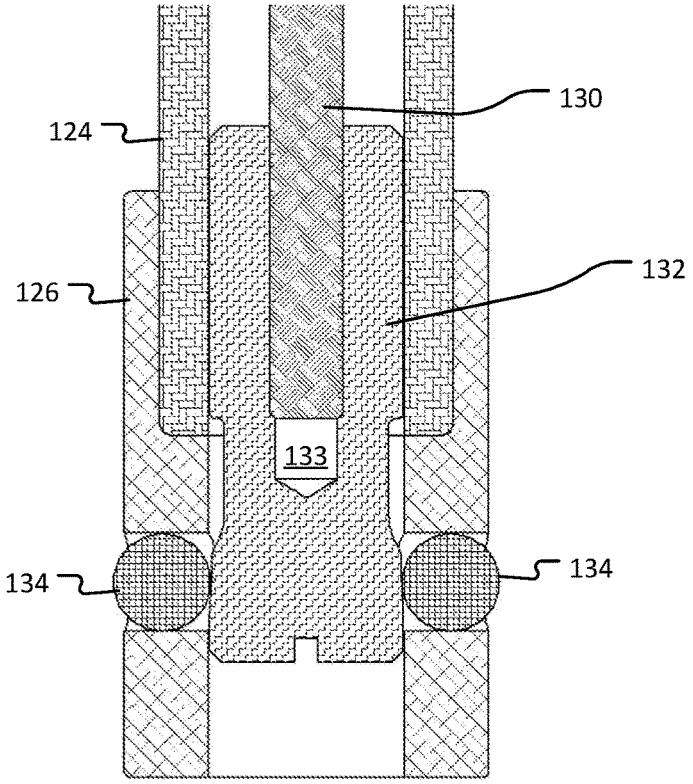
FIG. 5A is a cross-sectional view of a lower portion of a handle assembly according to one embodiment of the present invention.
Figure 5B:
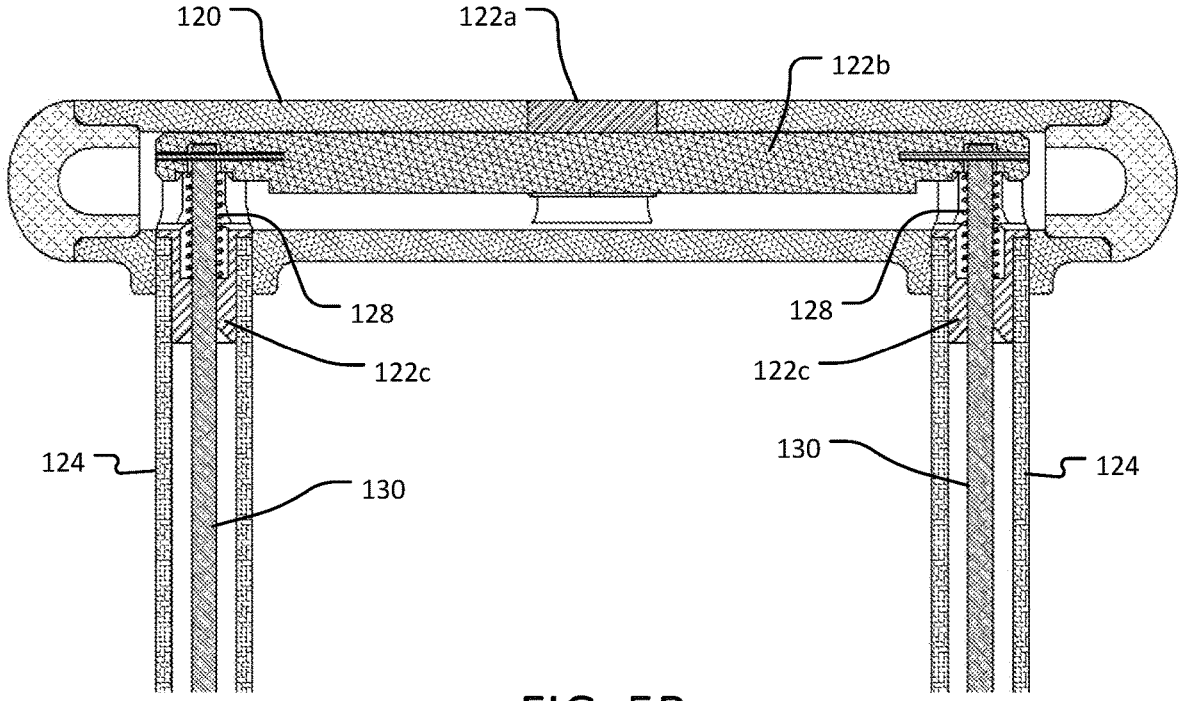
FIG. 5B is a cross-sectional view of an upper portion of a handle assembly according to one embodiment of the present invention.

Referring to FIGS. 5A-5B, cross-sectional views of a lower section and an upper section of the handle assembly 104 are illustrated, respectively. More specifically, a locking configuration for the handle assembly 104 is illustrated. As shown in FIG. 5A, the ball bearings 134 can interface with the locking region 132*a* of the ball bearing engagement member 132. Of note, the ball bearings 134 can protrude exteriorly to an outer surface of the cap 126 when interfacing with the locking region 132*a*. As previously mentioned, the ball bearing engagement member 132 and the ball bearings 134 can be manufactured from material having magnetic properties. As shown in FIG. 5B, the button assembly 122 can be at rest. The springs 128 can push the horizontal rod 122*b* up along with the button 122*a*. In this configuration, the rods 130 can each be pulled up and allowing the locking region 132*a* to interface with the ball bearings 134.

As will be shown hereinafter, when the ball bearing engagement members 132 moves from a locking to unlocking position, the ball bearings 134 can be magnetically coupled to the engagement member 132 and follow a contour of the outer surface of the engagement member 132. Of note, if the suitcase 190 were oriented at an angle (e.g., when rolling on wheels) or laying horizontal, ball bearings 134 located on a bottom side would want to drop down due to gravity. The magnetic coupling between the engagement member 132 and the ball bearings 134 can ensure that the ball bearings 134 retract when unlocking.

The rods 130 can be adjustably coupled to the ball bearing engagement members 132. In one instance, the ball bearing engagement members 132 can be threadably coupled to the rods 130. For example, the rods 130 can be sized to threadably insert into the bore 133 of the ball bearing engagement members 132. Of note, by providing the threaded bore 133 adapted to mate with the rod 130, a location of the ball bearing engagement member 132 can be adjusted relative to a location of the ball bearings 134. As can be appreciated, this can allow for an adjustability of an interaction between the ball bearing engagement member 132 and the ball bearings 134.

Figure 6A:
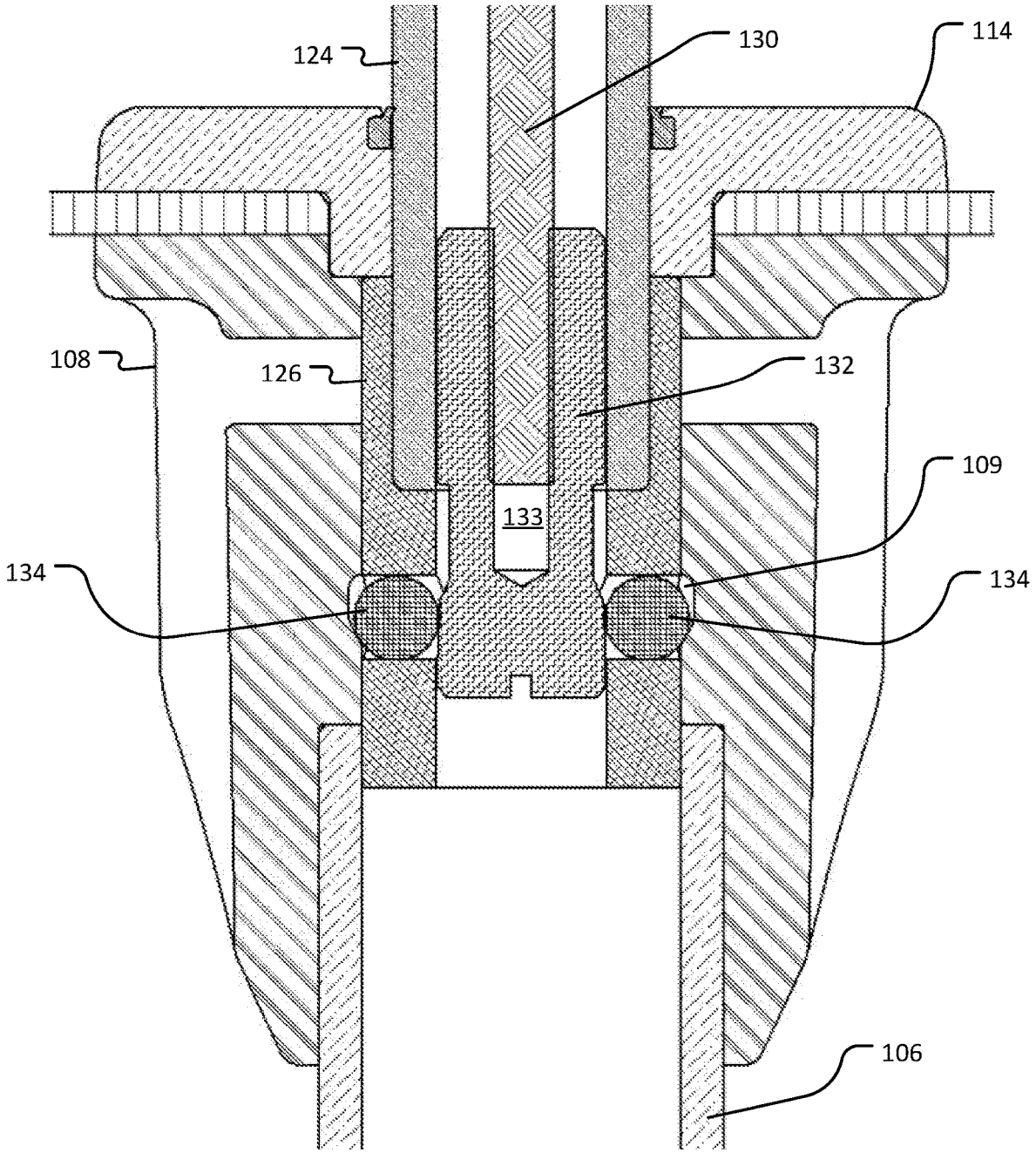
FIG. 6A is a close-up, cross-sectional view of an upper portion of a handle assembly and case upper according to one embodiment of the present invention.
Figure 6B:
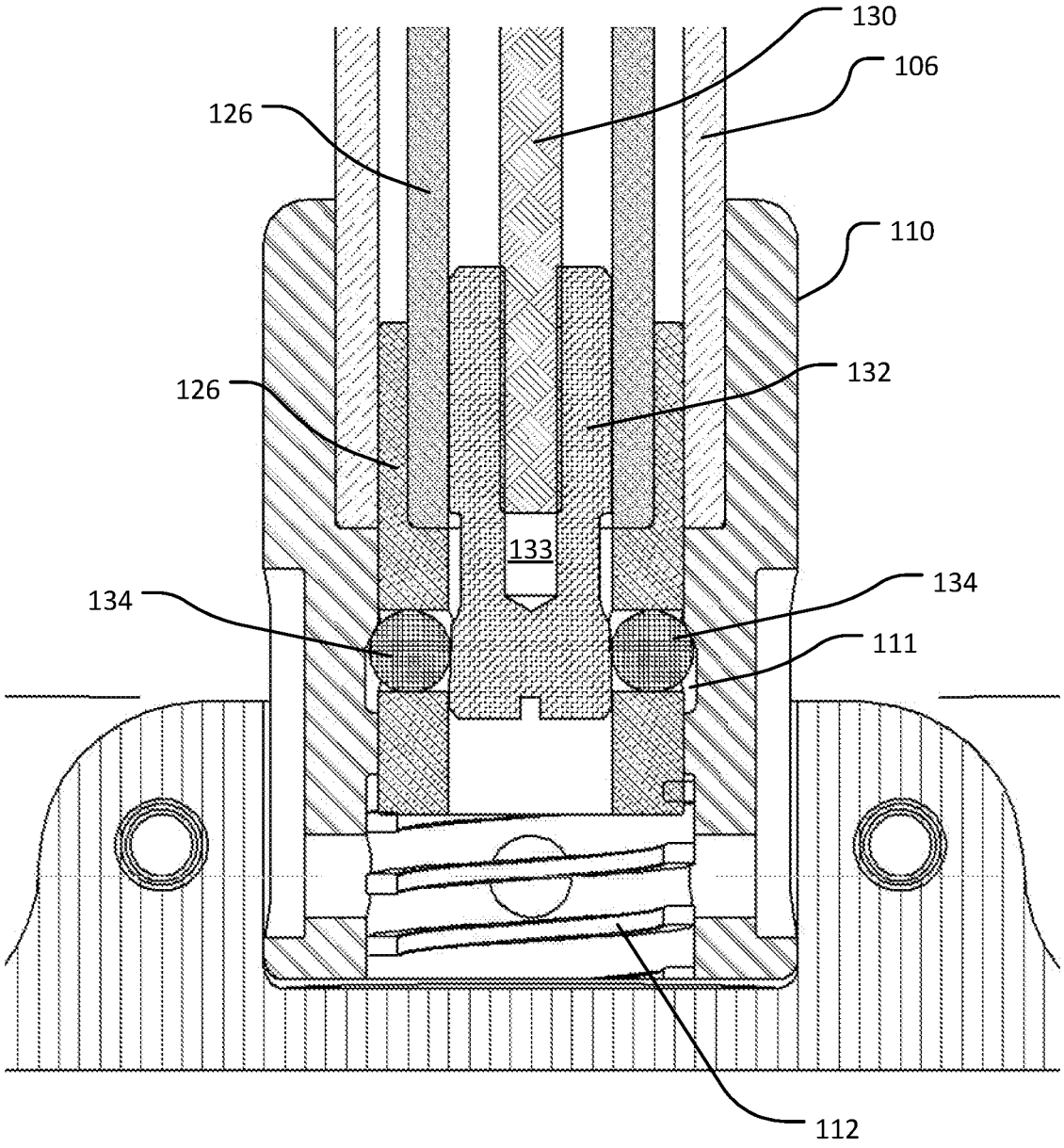
FIG. 6B is a close-up, cross-sectional view of a lower portion of a handle assembly and case lower according to one embodiment of the present invention.

Referring to FIGS. 6A-6B, cross-sectional views of the lower end of the handle assembly 104 interacting with each end of a case assembly 102 are illustrated. As shown in FIG. 6A, the case upper 108 can include the race 109 that can be configured to receive a portion of the ball bearings 134 therein. The case upper race 109 may be machined out of an interior surface of the case upper 108 such that the ball bearings 134 may partially insert into the race 109. In one instance, the race 109 can be a groove machined (or formed) around an interior circumference of the case upper 108. When the ball bearings 134 are inserted into the race 109, the handle assembly 104 can be restricted in moving. The handle assembly 104 can be further restricted from moving by the housing caps 126 interfacing with the case upper coupling member 114. As can be seen, a top of the housing caps 126 can directly interface with a bottom side of the case upper coupling member 114. The case upper race 109 and the case upper coupling member 114 can be implemented to lock the handle assembly 104 in an extended configuration.

The housings 124 and the caps 126 of the handle assembly 104 can be configured to slide within the case assembly housings 106 between the case upper 108 and the case lower 110. The caps 126 can be sized to fit snugly within the case assembly housings 106 while still being able to slide within the case assembly housings 106.

As shown in FIG. 6B, the case lower 110 can include the race 111 similar to the case upper race 109. The case lower race 111 can be implemented to lock the handle assembly 104 in a retracted configuration. For instance, when the ball bearings 134 interface with the case lower race 111, the handle assembly 104 can be precluded from moving. The spring 112 located inside the case lower 110 can be implemented to provide a constant force pushing on the handle assembly 104 to help remove any play in the handle assembly 104 when in the retracted configuration. As shown, the cap 126 can engage the spring 112. The spring 112 can push against the cap 126 when compressed, and thus push the ball bearings 134 towards an upper end of the race 111.

In some embodiments, the case upper race 109 and the case lower race 111 can be manufactured with a tapered geometry. The tapered geometry can allow the ball bearings 134 to contact a mating part outside of a bore of the case housings 106. Moving the contact location outside the bore of the case housings 106 can limit the potential for material deformation and moves a location of a potential material deformation away from the bore of the case housings 106. As can be appreciated, this can reduce potential obstructions between the housing cap 126 and the bore of the case housing 106.

Figure 7A:
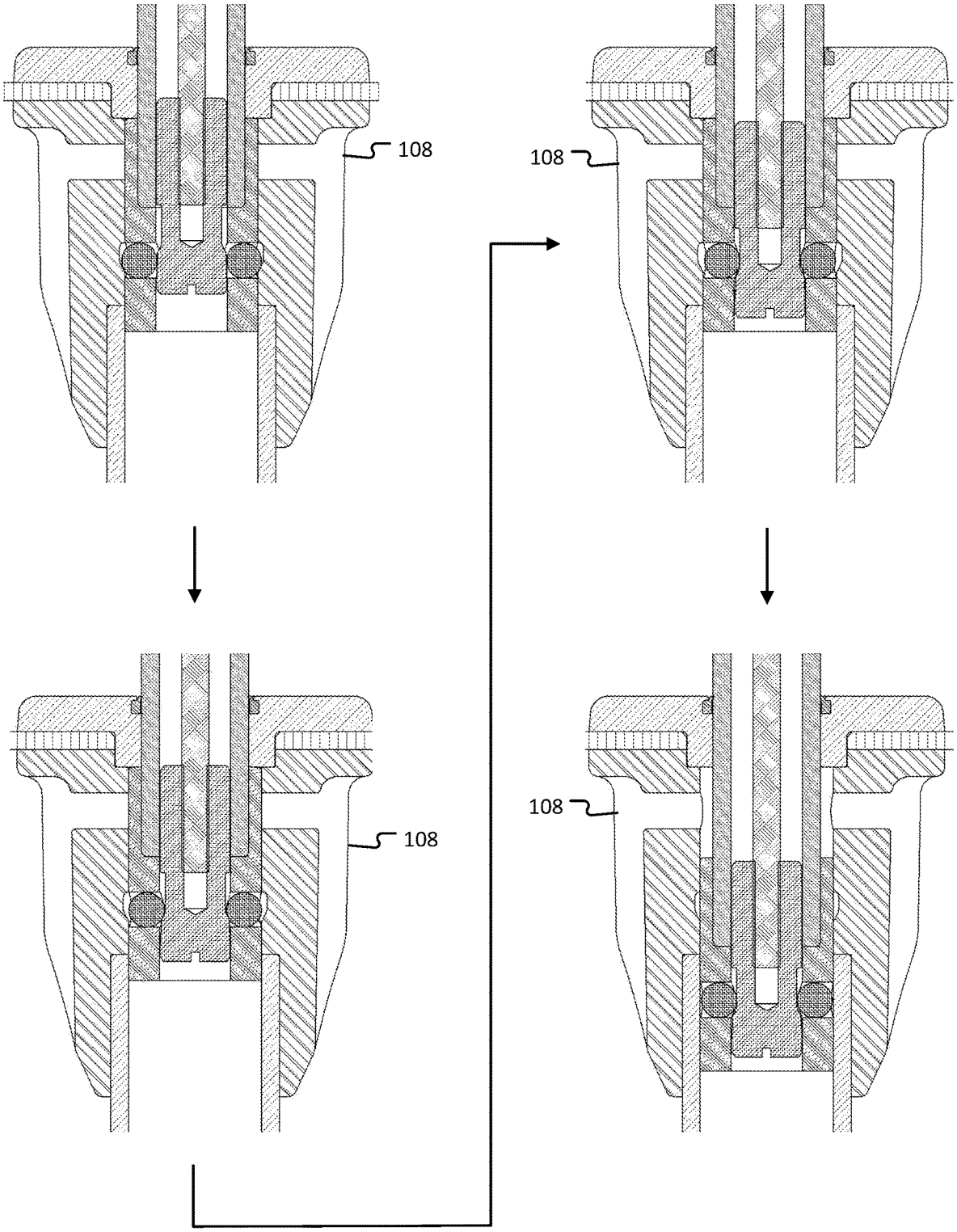
FIG. 7A illustrates an upper portion of a handle assembly going from a locked configuration to an unlocked configuration in a case upper according to one embodiment of the present invention.
Figure 7B:
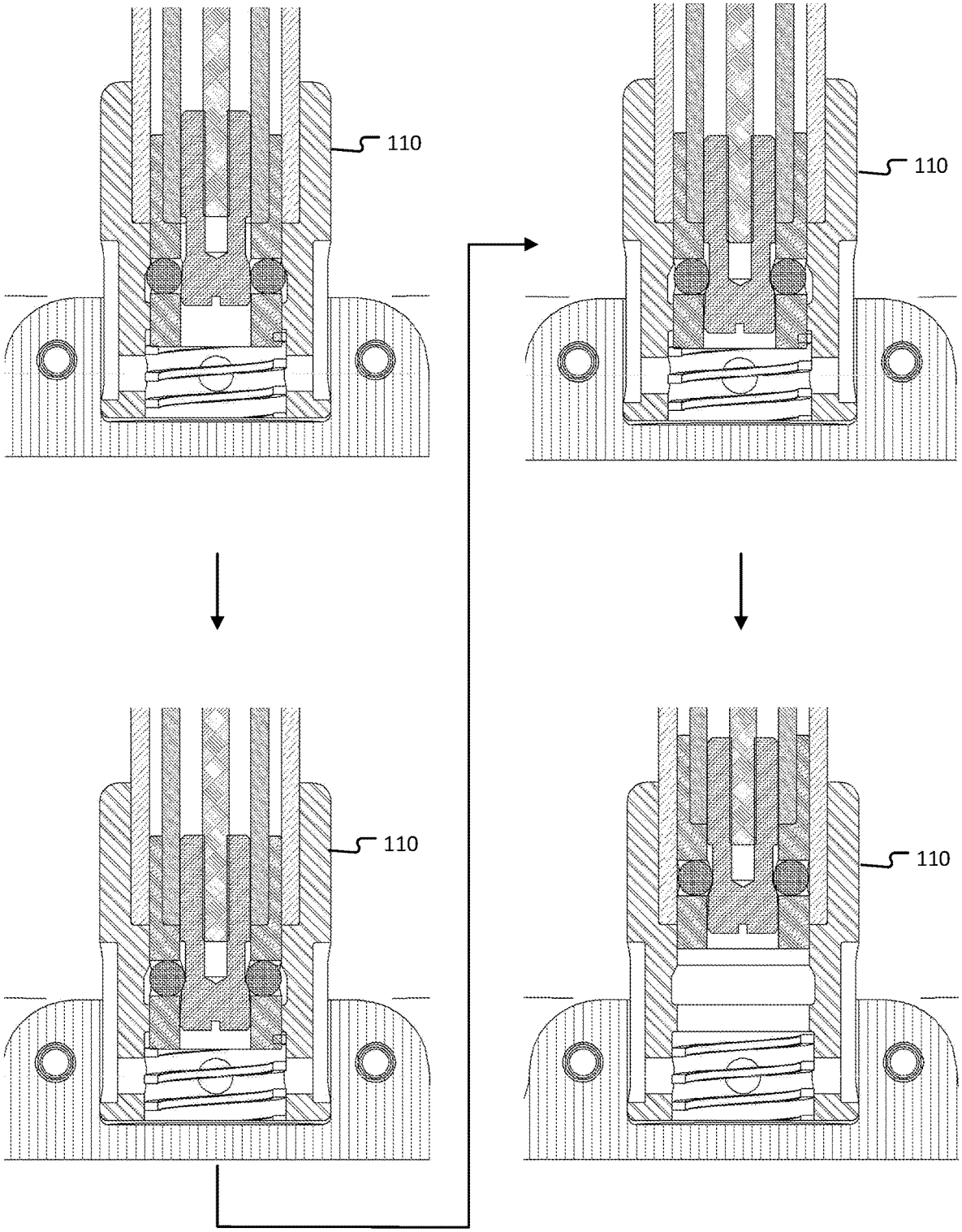
FIG. 7B illustrates a lower portion of a handle assembly going from a locked configuration to an unlocked configuration in a case lower according to one embodiment of the present invention.

Referring to FIGS. 7A-7B, detailed diagrams illustrating a sequence of the handle assembly 104 going from a locked configuration to an unlocked configuration are illustrated.

FIG. 7A shows how the handle assembly 104 can go from a locked configuration to an unlocked configuration when interacting with the case upper 108. To unlock the handle assembly 104, the button assembly 120 can be depressed which can move the rod 130 and the ball bearing engagement member 132. As the ball bearing engagement member 132 is moved, the ball bearings 134 can move from the locking region 132*a*, to the transition region 132*c*, and finally to the unlocking region 132*b* of the ball bearing engagement member 132. As previously mentioned, the ball bearing engagement members 132 and the ball bearings 134 can be manufactured from magnetic material. A magnetic coupling between the ball bearing engagement member 132 and the ball bearings 134 can help ensure that the ball bearings 134 remain in contact with the ball bearing engagement member 132 as the button assembly 120 is engaged.

FIG. 7B shows how the handle assembly 104 can go from a locked configuration to an unlocked configuration when interacting with the case lower 110. As can be appreciated, when the handle assembly 104 is in a retracted configuration, the handle assembly 104 can be engaged with the case lowers 110. To unlock the handle assembly 104, a user can depress the button 122*a* such that the rods 130 are moved down in relation to the case lower 110. The rods 130 are moved, the ball bearings 134 can move from the locking region 132*a* to the unlocking region 132*b* to allow the housings 126 to be moved upwards and away from the case lower 110.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A luggage handle comprising:

a handle;

a button assembly;

at least one housing having a first end coupled to the handle;

a cap member coupled to a second end of the housing, the cap member having at least one aperture;

a rod located within the housing;

a magnetic engagement member coupled to a second end of the rod, the magnetic engagement member being at least partially located within the housing and partially within the cap member; and at least one magnetic ball bearing interfacing directly with the magnetic engagement member and with the at least one aperture.

2. The luggage handle of claim 1, wherein the housing extends perpendicular to a longitudinal axis of the handle.

3. The luggage handle of claim 1, wherein a first end of the rod is operatively coupled to the button assembly.

4. The luggage handle of claim 1, wherein the magnetic engagement is threadably coupled to the second end of the rod.

5. The luggage handle of claim 4, wherein the button assembly is located substantially within the handle.

6. A luggage handle comprising:

a handle;

a button assembly;

a housing having a first end coupled to the handle and a second end including a plurality of apertures;

a rod having a first end operatively coupled to the button assembly;

a magnetic engagement member coupled to the second end of the rod; and a plurality of magnetic ball bearings interfacing directly with the magnetic engagement member and with the plurality of apertures of the housing.

7. The luggage handle of claim 6, wherein the housing extends perpendicular to a longitudinal axis of the handle.

8. The luggage handle of claim 6, wherein the rod includes a threaded second end.

9. The luggage handle of claim 8, wherein the magnetic engagement member includes a threaded bore for receiving the threaded second end of the rod.

10. A luggage handle comprising:

a handle assembly including (i) a magnetic engagement member and (ii) a plurality of magnetic ball bearings interfacing directly with the magnetic engagement member; and a case assembly including a housing, the housing including (i) a groove located in an upper interior of the housing, and (ii) a groove located in a lower interior of the housing;

wherein the plurality of ball bearings are each adapted to interface with the lower interior groove and the upper interior groove.

11. The luggage handle of claim 10, wherein the case assembly is integrated into a luggage shell.

* * * * *